US008622170B2

(12) United States Patent
Bean et al.

(10) Patent No.: US 8,622,170 B2
(45) Date of Patent: Jan. 7, 2014

(54) LIFT VEHICLE WITH MULTIPLE CAPACITY ENVELOPE CONTROL SYSTEM AND METHOD

(75) Inventors: Andrew Jay Bean, Greencastle, PA (US); James Latin Smith, Chambersburg, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 2575 days.

(21) Appl. No.: 10/786,158

(22) Filed: Feb. 26, 2004

(65) Prior Publication Data

US 2005/0224439 A1 Oct. 13, 2005

(51) Int. Cl.
*B66F 11/04* (2006.01)

(52) U.S. Cl.
USPC ..... 182/18; 182/2.11

(58) Field of Classification Search
USPC ..... 182/18, 19, 2.8–2.11
See application file for complete search history.

(56) References Cited

U.S. PATENT DOCUMENTS

| | | | | |
|---|---|---|---|---|
| 3,710,368 | A | 1/1973 | Hamilton | |
| 4,216,868 | A | 8/1980 | Geppert | |
| 4,395,706 | A | 7/1983 | Garber | |
| 4,456,093 | A * | 6/1984 | Finley et al. | 182/2.2 |
| 4,516,117 | A * | 5/1985 | Couture et al. | |
| 4,726,186 | A * | 2/1988 | Tatsumi et al. | 60/434 |
| 4,906,981 | A | 3/1990 | Nield | |
| 5,058,752 | A * | 10/1991 | Wacht et al. | 212/278 |
| 5,769,251 | A | 6/1998 | Wada et al. | |
| 6,405,114 | B1 * | 6/2002 | Priestley et al. | 701/50 |
| 2003/0173151 | A1 * | 9/2003 | Bodtke et al. | 182/18 |
| 2004/0200644 | A1 * | 10/2004 | Paine et al. | 177/136 |

FOREIGN PATENT DOCUMENTS

| | | |
|---|---|---|
| EP | 0 285 710 | 10/1988 |
| GB | 941833 | 11/1963 |

OTHER PUBLICATIONS

ThomasNet Industrial News: "Big Reach Ultra Boom Aerial Introduced by JLG", URL:http://news.thomasnet.com/fullstory/28171, Nov. 13, 2003, 2 pp.

ThomasNet Industrial Newsroom: "Boom Lift Offers Controlled Arc Work Envelope", URL:http://news.thomasnet.com/fullstory/11561, Jul. 2, 2002, 2 pp.

JLG Inc.: "Ultra Series Articulating and Telescopic Boom Lifts", URL:http://www.jlg.com/Products/PDF/UltraSeries.pdf, retrieved Apr. 26, 2005, 8 pp.

Omniquip: "Capacity Control System", URL:http://www.omniquip.com/Products/FAW/UltraSeriesFAW.asp, retrieved Apr. 26, 2005, 3 pp.

* cited by examiner

*Primary Examiner* — Alvin Chin Shue
(74) *Attorney, Agent, or Firm* — Nixon & Vanderhye P.C.

(57) ABSTRACT

A multiple envelope control system and method expands the operating capabilities of a lift vehicle. The vehicle includes a platform mounted to a telescoping main boom. The main boom is configured for lift/lower function and telescope function. The multiple envelope control system includes a selector switch for selecting between a plurality of capacity modes including at least a low load mode and a high load mode. A plurality of sensors are strategically positioned on the main boom to cooperatively define position zones of the platform. A control system determines in which position zone the platform located according to signals from the plurality of sensors. The control system controls an envelope of the platform based on a position of the selector switch. By strategically positioning the sensors to define the position zones, inexpensive switches, such as limit switches or the like, can be used, thereby reducing manufacturing costs of the machine.

11 Claims, 3 Drawing Sheets

LIFT VEHICLE WITH MULTIPLE CAPACITY ENVELOPE CONTROL SYSTEM AND METHOD

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to lift vehicles such as aerial work platform vehicles, telescopic handlers, and the like and, more particularly, to a lift vehicle including a multiple capacity system with multiple envelope control.

Boom lift vehicles are known that include a tower boom pivotally coupled to a vehicle base, and a main boom pivotally coupled to an opposite end of the tower boom. One or both of the tower boom and the main boom may also be capable of expansion and retraction via telescope sections. A jib arm may be pivotally attached at an end of the main boom to support an aerial work platform.

Existing lift vehicles typically define a safe operating envelope for positioning the aerial work platform relative to the vehicle base. The envelope is conventionally determined based on a maximum load capacity of the aerial work platform. As a consequence, when the aerial work platform supports a collective mass lower than the maximum load, safe operating positions of the aerial work platform may in fact extend beyond the envelope. As a consequence, when the aerial work platform supports a reduced load, the vehicle is not being used to its full capabilities.

JLG Inc.'s 1350SJP utilized a dual capacity "control" system in which the envelope was automatically limited by the control system to stay within selectable envelopes. The previous method was purely an "indication" system in which the envelope was indicated to the operator who had the responsibility to prevent the boom from leaving the envelope matching the desired capacity. The 1350SJP had, as a part of the primary control system, "infinite" length and "infinite" angle measuring sensors necessary to determine the position of the boom within the envelope, as none of the envelopes could be bounded by mechanical limits. The known "infinite" lengths and angles were used to redefine the shape of the envelope for the restricted capacity envelope. The 1350SJP used "controlled arc" to automatically navigate the envelope edges in the same way for both capacities. Other than reducing the envelope size and restricting the functionality of the side swing jib, the machine worked the same regardless of the capacity mode selection.

BRIEF SUMMARY OF THE INVENTION

It would thus be desirable to define multiple safe operating envelopes for the aerial work platform based on a reduced load supported by the platform. Additionally, it would be desirable to determine a position of the aerial work platform using less expensive sensors such as limit switches to thereby reduce vehicle manufacturing costs.

The present invention proposes a multiple capacity system encompassing a multiple envelope control system that changes the allowable working envelope to match the selected capacity in a plurality of modes such as either a low load mode (e.g., 500 lb. capacity) or a high load mode (e.g., 1000 lb. capacity) with possible additional interim modes. The system displays the capacity mode on the platform and ground display panels and controls the positions of the main boom within the allowable envelope for that mode. The mode is selectable by the operator with a multiple capacity select switch on the platform control panel. Additionally, the system utilizes inexpensive sensors to determine a position of the aerial work platform relative to the vehicle base.

The machine incorporates a mixture of "infinite" measuring sensors and discrete position measuring switches (digital switches). Due to the tower path and main boom angle control, with "infinite" precision the angles of the main boom are known, but the machine does not need the "infinite" length of the main boom for any reason other than the restricted envelope control for increased capacity. The cost vs. benefit for adding "infinite" length measuring is not justifiable when less expensive digital switches can safely prevent the boom from attaining positions outside the safe limits for higher capacity operation.

In doing this however, the system has different operational characteristics between capacity modes. For example, in the 500 lb mode, other than the max and min angles being electrically controlled, the main boom is mechanically unrestricted, and therefore the control system does not have lift and telescope interactions of the main boom. In the 1000 lb mode, the main boom is restricted by forcing the operator to navigate around a restricted length region by imposing lift and telescope interaction restrictions of the main boom. This will cause interrupted movements of the main boom function not seen within the 500 lb mode.

It is also possible, if the "infinite" angle measurement was not already present as part of the tower path and main boom angle control, to determine the angles of the main boom using digital switches in a manner similar to the length switches.

In an exemplary embodiment of the invention, a multiple envelope control system is provided for a lift vehicle. The lift vehicle includes an aerial work platform mounted to a telescoping main boom, which is configured for lift/lower function and telescope function. The multiple envelope control system includes a selector switch for selecting between a plurality of capacity modes including at least a low load mode and a high load mode, and a plurality of sensors, preferably limit switches, strategically positioned on the main boom that cooperatively define position zones of the aerial work platform. A control system communicating with the selector switch and the plurality of sensors receives output from the plurality of sensors to determine in which position zone the aerial work platform is located. The control system controls an envelope of the aerial work platform based on a position of the selector switch. In one arrangement, the control system controls a position of the selector switch according to a sensed load on the platform.

The control system may be configured such that when the selector switch is in the high load mode, the control system selectively prevents at least one of the lift/lower function and the telescope function based on which position zone the aerial work platform is located in. In this context, the control system is configured to selectively prevent at least one of the lift/lower function and the telescope function when an angle of the main boom relative to gravity is between +55° and −45°. An alarm may be activated when the aerial work platform is placed in a position outside of the envelope, or when the selector switch is shifted from the low load mode to a higher load mode with the aerial work platform located outside of the envelope.

The position zones defined by the plurality of sensors preferably include a plurality of angle regions, such as eight angle regions, corresponding to an angle of the main boom relative to gravity, and a plurality of length regions, such as four length regions, corresponding to a telescoped length of the main boom.

Additionally, the control system may be configured permit the main boom lift/lower function and telescope function according to the following schedule, where A-D correspond to the four length regions and R1-R8 correspond to the eight angle regions:

| | Main Boom Multiple Capacity Zone | | | |
|---|---|---|---|---|
| Functions | A | B | C | D |
| Main Lift UP | R1, R2, R3, R4, R5, R6, R7, R8 | R1, R2, R3, R4, R5, R6, R7, R8 | R1, R2, R3, R4, R5, R6, R7, R8 | R1, R2, R3, R4, R8 |
| Main Lift Down | R1, R2, R3, R4, R5, R6, R7, R8 | R1, R2, R3, R4, R5, R6, R7, R8 | R1, R2, R3, R4, R5, R6, R7, R8 | R1, R5, R6, R7, R8 |
| Main Tele Out | R1, R2, R3, R4, R5, R6, R7, R8 | R1, R2, R3, R4, R5, R6, R7, R8 | R1, R2, R7, R8 | R1, R2, R7, R8 |
| Main Tele In | R1, R2, R3, R4, R5, R6, R7, R8 | R1, R2, R3, R4, R5, R6, R7, R8 | R1, R2, R3, R4, R5, R6, R7, R8 | R1, R2, R3, R6, R7, R8 |

The sensors or limit switches include first and second multiple capacity switches and first and second main transport switches, where the control system is configured to respectively use opposite cam logic with the multiple capacity switches and the main transport switches to determine in which length region the aerial work platform is located. In this context, the control system determines which length region (A, B, C, D) the aerial work platform is located in according to the following schedule:

| | Switch States/Boom Length Regions | | | | | | | | |
|---|---|---|---|---|---|---|---|---|---|
| Multiple Cap. Switch #1 | Off Cam | Off Cam | Off Cam | Disagree | On Cam | On Cam | On Cam | Disagree | Disagree |
| Multiple Cap. Switch #2 | On Cam | On Cam | On Cam | Disagree | Off Cam | Off Cam | Off Cam | Disagree | Disagree |
| Control System Conclusion of Multiple Cap Switches | B/A | B/A | B/A | Disagree | C/D | C/D | C/D | Disagree | Disagree |
| Main Transport Switch #1 | Off Cam | Disagree | On Cam | On Cam | On Cam | Disagree | Off Cam | Off Cam | Disagree |
| Main Transport Switch #2 | On Cam | Disagree | Off Cam | Off Cam | Off Cam | Disagree | On Cam | On Cam | Disagree |
| Control System Conclusion of Main Transport Switches | A/D | Disagree | B/C | B/C | B/C | Disagree | A/D | A/D | Disagree |
| Control System Conclusion of Main Boom Length | A | A/B | B | B/C | C | C/D | D | Switch Fault | Switch Fault |

In another exemplary embodiment of the invention, a lift vehicle includes a vehicle base; a tower boom pivotally coupled at one end to the vehicle base; a telescoping main boom pivotally coupled to the tower boom at an opposite end thereof; a platform mounted to the telescoping main boom, the telescoping main boom being configured for lift/lower function and telescope function; a selector switch for selecting between a plurality of capacity modes including at least a low load mode and a high load mode; and the multiple envelope control system of the invention.

In yet another exemplary embodiment of the invention, a method of controlling an envelope of a platform is provided for the lift vehicle. The method includes the steps of (a) the control system receiving output from the plurality of sensors and determining in which position zone the platform is located; and (b) controlling an envelope of the platform based on a position of the selector switch by selectively preventing at least one of the lift/lower function and the telescope function based on which position zone the platform is located in.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
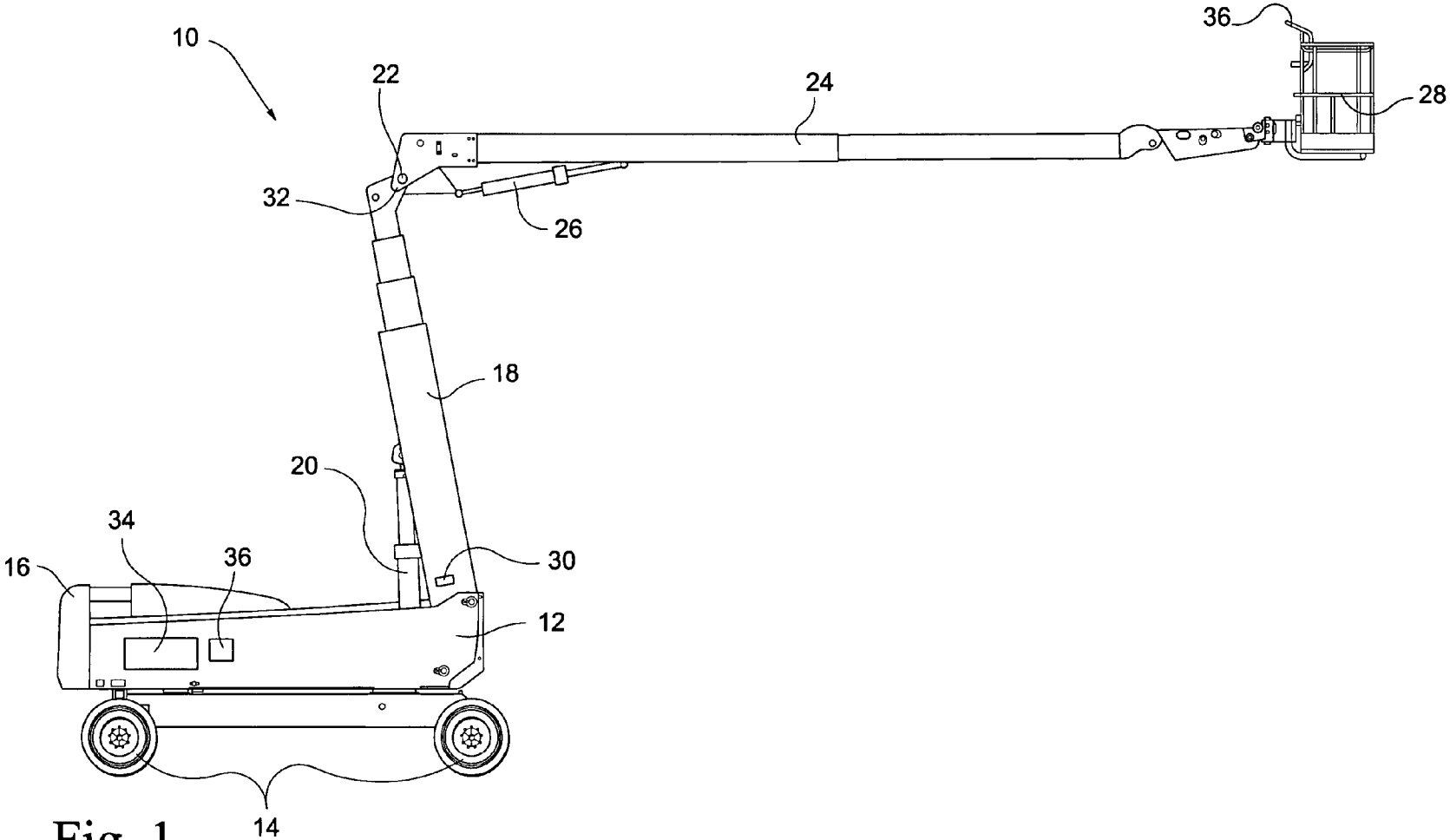
FIG. 1 is a schematic illustration of a lift vehicle.

With reference to FIG. 1, an aerial work platform (AWP) vehicle 10 generally includes a vehicle base 12 supported by a plurality of wheels 14. A counterweight 16 is fixed to the vehicle base 12 to counterbalance turning moments generated by the vehicle boom components. The vehicle base 12 also houses suitable drive components coupled with the vehicle wheels 14 for driving the vehicle.

A telescoping tower boom 18 is pivotally coupled at one end to the vehicle base 12. A lifting member 20 such as a hydraulic cylinder is disposed between the tower boom 18 and the vehicle base 12 for effecting tower lift functions. The tower boom 18 includes telescope sections that are coupled with suitable driving means (not shown) to effect telescope extend/retract functions. A nose pin 22 of the tower boom is disposed at an uppermost end of the tower boom 18 opposite the end pivotally attached to the vehicle base 12.

A main boom 24 is pivotally coupled to the tower boom 18 at the tower boom nose pin 22. A suitable lifting mechanism 26 such as a hydraulic cylinder drives a position of the main boom 24 relative to the tower boom 18. The main boom 24 may also include telescope sections coupled with a suitable driving mechanism (not shown) to effect telescope functions of the main boom 24.

An aerial work platform 28 is supported by a jib arm 29 pivotally secured to an outermost end of the main boom 24.

As shown in FIG. 1, in contrast with conventional articulating AWP vehicles, the tower boom 18 and the main boom 24 are without a conventional upright between them. Typically, an upright between articulating booms serves to maintain the orientation of, for example, the main boom as the tower boom is raised. The boom lift vehicle 10 of the present invention eliminates such an upright and rather utilizes sensors for sensing an angle of the main boom relative to gravity. In particular, an inclinometer 30 is attached to the tower boom 18 for measuring an angle of the tower boom 18 relative to gravity. A rotation sensor 32 is coupled between the tower boom 18 and the main boom 24 for determining a relative position of the tower boom 18 and the main boom 24. A control system 34 controls lift and telescope functions of the tower boom 18 and the main boom 24. Output from the inclinometer 30 and the rotation sensor 32 are processed by the controller 34, and the main boom angle relative to gravity can thus be determined. Alternatively, an inclinometer may be coupled directly with the main boom 24.

regions 50 correspond to the telescope length of the main boom 24. Of course, the number of angle and length regions is exemplary as more or fewer may be utilized, and the invention is not necessarily meant to be limited to the described example. Additionally, the specific angles that delimit the angle regions may be varied and thus are generically presented in FIG. 3 in even increments.

A selector switch 36 enables the operator to select between a plurality of capacity modes including at least a low load mode (e.g., 500 lb.) and a high load mode (e.g., 1000 lb.). In one arrangement, the control system 34 itself controls a position of the selector switch 36 according to a sensed load on the platform using known load sensing structure. In the high load mode, the control system 34 selectively prevents one or both of the main lift/lower functions and the main telescope function based on which position zone the aerial work platform 28 is located in. Table 1 lists the functions of the main boom 24 as main lift up, main lift down, main telescope out, and main telescope in. The control system permits the noted functions depending on the position zone in which the aerial work platform 28 is located. Table 1 lists the angle regions 48 in which the functions are permitted according to which length region 50 is detected.

| | Main Boom Multiple Capacity Zone | | | |
|---|---|---|---|---|
| Functions | A | B | C | D |
| Main Lift UP | R1, R2, R3, R4, R5, R6, R7, R8 | R1, R2, R3, R4, R5, R6, R7, R8 | R1, R2, R3, R4, R5, R6, R7, R8 | R1, R2, R3, R4, R8 |
| Main Lift Down | R1, R2, R3, R4, R5, R6, R7, R8 | R1, R2, R3, R4, R5, R6, R7, R8 | R1, R2, R3, R4, R5, R6, R7, R8 | R1, R5, R6, R7, R8 |
| Main Tele Out | R1, R2, R3, R4, R5, R6, R7, R8 | R1, R2, R3, R4, R5, R6, R7, R8 | R1, R2, R7, R8 | R1, R2, R7, R8 |
| Main Tele In | R1, R2, R3, R4, R5, R6, R7, R8 | R1, R2, R3, R4, R5, R6, R7, R8 | R1, R2, R3, R4, R5, R6, R7, R8 | R1, R2, R3, R6, R7, R8 |

Figure 2:
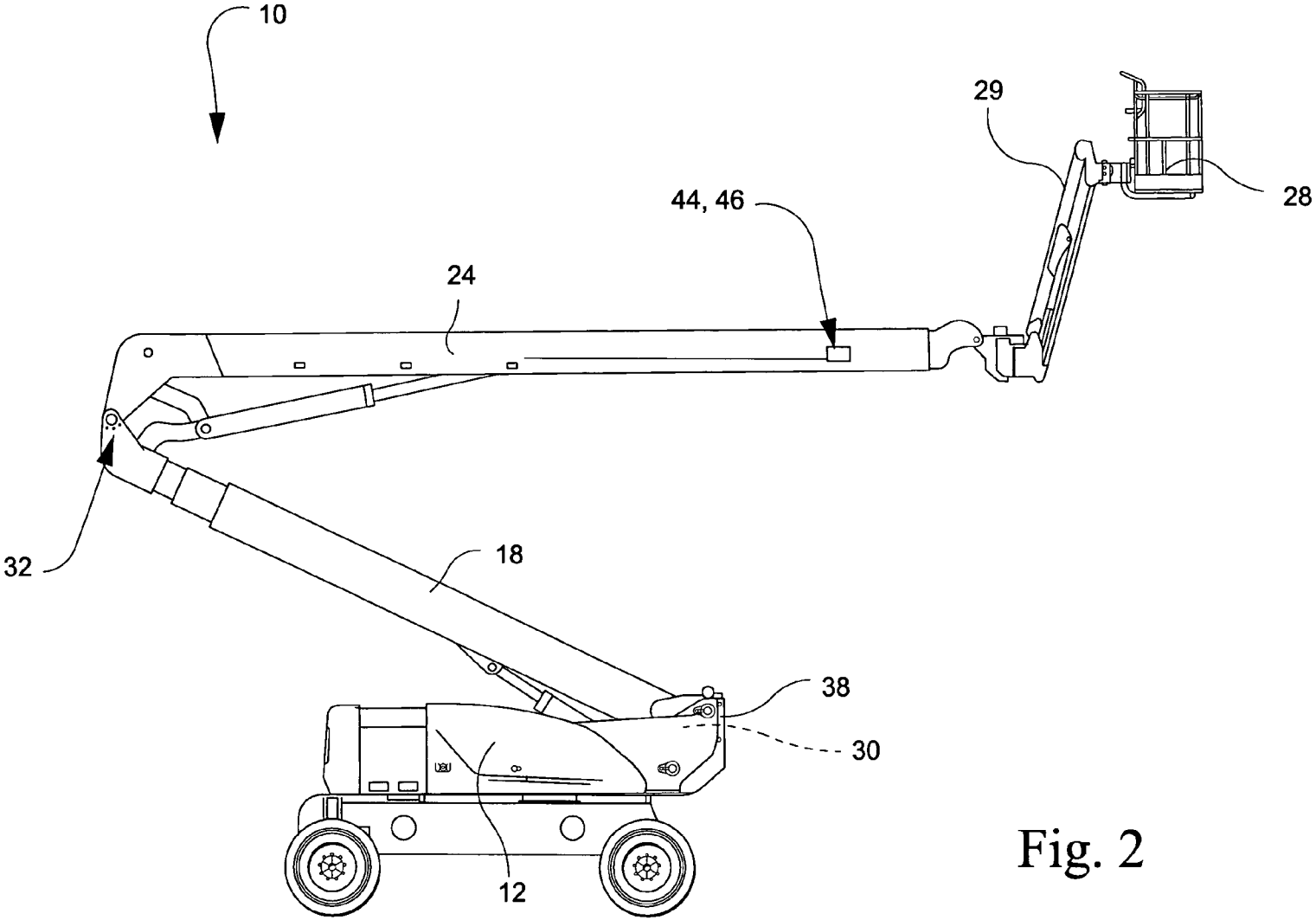
FIG. 2 illustrates the lift vehicle and the positioning of various sensors.
Figure 4:
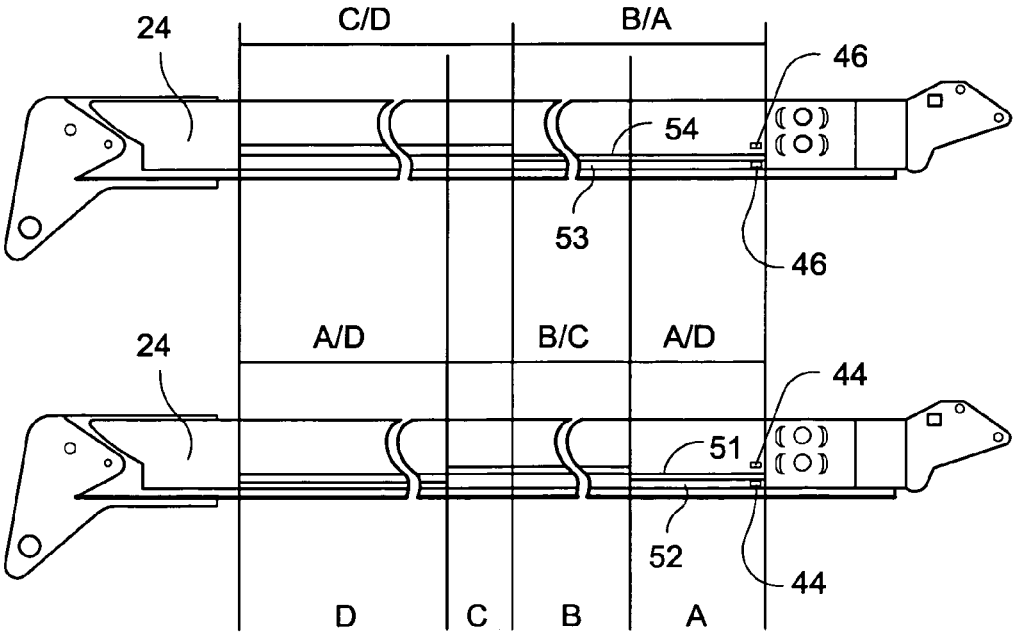
FIG. 4 shows the multiple capacity/transport switches mounted on the main boom.

With reference to FIGS. 2 and 4, a plurality of sensors detect various positions of the vehicle components, which ultimately can be used to determine a position of the platform 28. The sensors include a tower length sensor 38, a tower angle sensor 30, a main boom angle sensor 32, a pair of main boom transport length switches 44, and a pair of multiple capacity length switches 46. The tower length sensor 38 communicates with the control system 34 to determine a telescoped length of the tower boom 18. The main boom angle sensor 32 communicates with the controller 34 to determine an angle of the main boom 24 relative to the tower boom 18. As described in more detail below, the pair of main boom transport length switches 44 and the pair of multiple capacity length switches 46 are used to determine a length of the main boom 24 and thus a position of the platform 28 relative to the vehicle base 12. The tower length sensors 38 are primarily used for tower path control and are not specifically used to determine the capacity regions. Their role is important in determining the stability of the machine.

Figure 3:
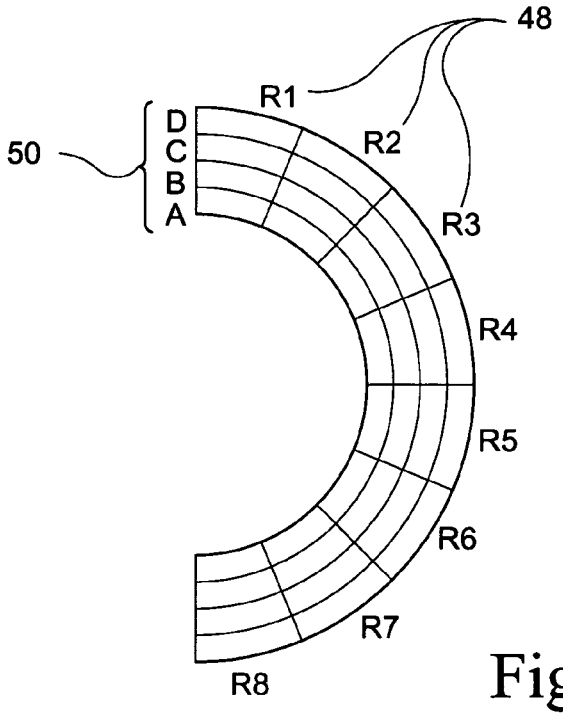
FIG. 3 illustrates exemplary position zones defined by sensors on the lift vehicle.

The plurality of sensors 30, 32, 38, 44, 46 are strategically positioned on the vehicle 10 to cooperatively define position zones of the aerial work platform 28. With reference to FIG. 3, the position zones defined by the plurality of sensors generally include eight angle regions 48 (R1-R8) and four length regions 50 (A-D). The angle regions 48 correspond to an angle of the main boom 24 relative to gravity. The length As discussed above, an angle of the main boom 24 relative to gravity, and thus the angle region 48 of the main boom, is preferably determined using an inclinometer 30 mounted on the tower boom 18 and a rotation sensor 32 that determines an angle of the main boom 24 relative to the tower boom 18. The length region 50 is determined based on output from the pair of main transport switches 44 and the pair of multiple capacity switches 46. With reference to FIG. 4 and Table 2, each of the main transport switches 44 ride on respective cam surfaces 51, 52 as the main boom 24 is telescoped in and out. Similarly, the multiple capacity switches 46 each ride on respective cam surfaces 53, 54. Depending on whether the switch combination 44, 46 is "on cam" or "off cam," the control system 34 can determine in which length zone the main boom 24 is positioned. Table 2 lists the possible readings of the transport switches 44 and the multiple capacity switches 46 and the control system's 34 respective conclusion regarding the length region 50 for each set of switches. With this information, the control system 34 makes the conclusion of main boom length (length region) based on the separate conclusions from the respective switches 44, 46. As shown in Table 2, in some instances, certain readings will lead the control system 34 to conclude that one or more of the switches is faulty.

| | Switch States/Boom Length Regions | | | | | | | | |
|---|---|---|---|---|---|---|---|---|---|
| Multiple Cap. Switch #1 | Off Cam | Off Cam | Off Cam | Disagree | On Cam | On Cam | On Cam | Disagree | Disagree |
| Multiple Cap. Switch #2 | On Cam | On Cam | On Cam | Disagree | Off Cam | Off Cam | Off Cam | Disagree | Disagree |
| Control System Conclusion of Multiple Cap Switches | B/A | B/A | B/A | Disagree | C/D | C/D | C/D | Disagree | Disagree |
| Main Transport Switch #1 | Off Cam | Disagree | On Cam | On Cam | On Cam | Disagree | Off Cam | Off Cam | Disagree |
| Main Transport Switch #2 | On Cam | Disagree | Off Cam | Off Cam | Off Cam | Disagree | On Cam | On Cam | Disagree |
| Control System Conclusion of Main Transport Switches | A/D | Disagree | B/C | B/C | B/C | Disagree | A/D | A/D | Disagree |
| Control System Conclusion of Main Boom Length | A | A/B | B | B/C | C | C/D | D | Switch Fault | Switch Fault |

In operation, the control system 34 displays the selected capacity mode on both platform and ground displaying panels, and as noted, controls the positions of the boom within the allowable envelope for that mode. To select the high load mode, the main boom 24 must already be in the high load mode envelope and the jib arm 29 must be centered, within 10°, verified to the control system 34 by a jib centered limit switch mounted on a side swing rotator of the jib arm 29. When the operator selects the high load mode and these conditions are met, the control system changes the capacity light from the low load mode to the high load mode, jib swing is disallowed, and the envelope is changed accordingly. When the operator selects the high load mode and these conditions are not met, the control system will flash both capacity lights, a platform alarm will sound, and all functions except jib swing will be disabled until the capacity select switch is put back into the low load position. Operation of jib swing in this condition can be used to find the center position of the jib 29 as the jib swing function will stop when the center position is reached.

With the system and method of the present invention, by modifying a safe operating envelope based on a selected load capacity, capabilities of a lift vehicle can be extended. Additionally, the use of inexpensive sensors to define position zones enables the control system to monitor vehicle component positions including a position of the aerial work platform, while reducing manufacturing costs for the vehicle.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A multiple envelope control system for a lift vehicle, the lift vehicle including a platform mounted to a telescoping main boom, the main boom being configured for lift/lower function and telescope function, the multiple envelope control system comprising:

a selector switch for selecting between a plurality of capacity modes including at least a low load mode and a high load mode;

a plurality of sensors strategically positioned on the main boom, the sensors cooperatively defining position zones of the platform; and a control system communicating with the selector switch and the plurality of sensors, the control system receiving output from the plurality of sensors to determine in which position zone the platform is located, wherein the control system controls a predefined envelope of the platform based on a position of the selector switch and controls operation of the main boom based on which position zone the platform is located in, and wherein the control system is configured such that when the selector switch is in the high load mode, the control system selectively prevents at least one of the lift/lower function and the telescope function based on which position zone the platform is located in.

2. A multiple envelope control system according to claim 1, wherein the control system is configured to selectively prevent at least one of the lift/lower function and the telescope function when an angle of the main boom relative to gravity is between +55° and −45°.

3. A multiple envelope control system according to claim 1, further comprising alarm means for activating an alarm when the platform is placed in a position outside of the envelope.

4. A multiple envelope control system for a lift vehicle, the lift vehicle including a platform mounted to a telescoping main boom, the main boom being configured for lift/lower function and telescope function, the multiple envelope control system comprising:

a selector switch for selecting between a plurality of capacity modes including at least a low load mode and a high load mode;

a plurality of sensors strategically positioned on the main boom, the sensors cooperatively defining position zones of the platform; and a control system communicating with the selector switch and the plurality of sensors, the control system receiving output from the plurality of sensors to determine in which position zone the platform is located, wherein the control system controls an envelope of the platform based on a position of the selector switch, and wherein the control system is configured such that when the selector switch is in the high load mode, the control system selectively prevents at least one of the lift/lower function and the telescope function based on which position zone the platform is located in, wherein the position zones defined by the plurality of sensors comprise a plurality of angle regions corresponding to an angle of the main boom relative to gravity and a plurality of length regions corresponding to a telescoped length of the main boom.

5. A multiple envelope control system according to claim 4, wherein the position zones defined by the plurality of sensors comprise eight angle regions corresponding to the angle of the main boom relative to gravity and four length regions corresponding to the telescoped length of the main boom.

6. A multiple envelope control system according to claim 5, wherein the control system is configured permit the main boom lift/lower function and telescope function according to the following schedule, where A-D correspond to the four length regions and R1-R8 correspond to the eight angle regions:

| Functions | A | B | C | D |
|---|---|---|---|---|
| Main Lift UP | R1, R2, R3, R4, R5, R6, R7, R8 | R1, R2, R3, R4, R5, R6, R7, R8 | R1, R2, R3, R4, R5, R6, R7, R8 | R1, R2, R3, R4, R8 |
| Main Lift Down | R1, R2, R3, R4, R5, R6, R7, R8 | R1, R2, R3, R4, R5, R6, R7, R8 | R1, R2, R3, R4, R5, R6, R7, R8 | R1, R5, R6, R7, R8 |
| Main Tele Out | R1, R2, R3, R4, R5, R6, R7, R8 | R1, R2, R3, R4, R5, R6, R7, R8 | R1, R2, R7, R8 | R1, R2, R7, R8 |
| Main Tele In | R1, R2, R3, R4, R5, R6, R7, R8 | R1, R2, R3, R4, R5, R6, R7, R8 | R1, R2, R3, R4, R5, R6, R7, R8 | R1, R2, R3, R6, R7, R8. |

7. A multiple envelope control system according to claim 1, wherein the plurality of sensors comprise limit switches.

8. A multiple envelope control system according to claim 7, wherein the position zones defined by the plurality of sensors comprise a plurality of length regions corresponding to a telescoped length of the main boom, and wherein the limit switches comprise first and second multiple capacity switches and first and second main transport switches, the control system being configured to respectively use opposite cam logic with the multiple capacity switches and the main transport switches to determine in which length region the platform is located.

9. A multiple envelope control system according to claim 8, wherein the position zones defined by the plurality of sensors comprise four length regions (A, B, C, D) corresponding to a telescoped length of the main boom, the control system determining which length region the platform is located in according to the following schedule:

| | Switch States/Boom Length Regions | | | | | | | | |
|---|---|---|---|---|---|---|---|---|---|
| Multiple Cap. Switch #1 | Off Cam | Off Cam | Off Cam | Disagree | On Cam | On Cam | On Cam | Disagree | Disagree |
| Multiple Cap. Switch #2 | On Cam | On Cam | On Cam | Disagree | Off Cam | Off Cam | Off Cam | Disagree | Disagree |
| Control System Conclusion of Multiple Cap Switches | B/A | B/A | B/A | Disagree | C/D | C/D | C/D | Disagree | Disagree |
| Main Transport Switch #1 | Off Cam | Disagree | On Cam | On Cam | On Cam | Disagree | Off Cam | Off Cam | Disagree |
| Main Transport Switch #2 | On Cam | Disagree | Off Cam | Off Cam | Off Cam | Disagree | On Cam | On Cam | Disagree |
| Control System Conclusion of Main Transport Switches | A/D | Disagree | B/C | B/C | B/C | Disagree | A/D | A/D | Disagree |
| Control System Conclusion of Main Boom Length | A | A/B | B | B/C | C | C/D | D | Switch Fault | Switch Fault. |

10. A multiple envelope control system for a lift vehicle, the lift vehicle including a platform mounted to a telescoping main boom, the main boom being configured for lift/lower function and telescope function, the multiple envelope control system comprising:

a selector switch for selecting between a plurality of capacity modes including at least a low load mode and a high load mode;

a plurality of sensors strategically positioned on the main boom, the sensors cooperatively defining position zones of the platform; and a control system communicating with the selector switch and the plurality of sensors, the control system receiving output from the plurality of sensors to determine in which position zone the platform is located, wherein the control system controls a predefined envelope of the platform based on a position of the selector switch and controls operation of the main boom based on which position zone the platform is located in, and wherein the control system controls a position of the selector switch according to a sensed load on the platform.

11. A lift vehicle comprising:

a vehicle base;

a tower boom pivotally coupled at one end to the vehicle base;

a telescoping main boom pivotally coupled to the tower boom at an opposite end thereof;

a platform mounted to the telescoping main boom, the telescoping main boom being configured for lift/lower function and telescope function; and a multiple envelope control system including:

a selector switch for selecting between a plurality of capacity modes including at least a low load mode and a high load mode, a plurality of sensors strategically positioned on the main boom, the sensors cooperatively defining position zones of the platform, and a control system communicating with the selector switch and the plurality of sensors, the control system receiving output from the plurality of sensors to determine in which position zone the platform is located, wherein the control system controls a predefined envelope of the platform based on a position of the selector switch and controls operation of the main boom based on which position zone the platform is located in, and wherein the control system is configured such that when the selector switch is in the high load mode, the control system selectively prevents at least one of the lift/lower function and the telescope function based on which position zone the platform is located in.

* * * * *